US009462367B2

(12) United States Patent
Yeung et al.

(10) Patent No.: US 9,462,367 B2
(45) Date of Patent: Oct. 4, 2016

(54) JACK FOR PREVENTING HEADPHONE FROM INPUTTING DOUBLE AUDIO SOURCES

(71) Applicant: CHARTER MEDIA (DONGGUAN) CO., LTD., Guangdong (CN)

(72) Inventors: Siu Chung Yeung, Guangdong (CN); Man Tai Vincent Lam, Guangdong (CN); Kin Liauw, Guangdong (CN)

(73) Assignee: CHARTER MEDIA(DONGGUAN) CO.,LTD, Dongguan, Guangdong (CN)

( * ) Notice: Subject to any disclaimer, the term of this patent is extended or adjusted under 35 U.S.C. 154(b) by 247 days.

(21) Appl. No.: 14/382,348

(22) PCT Filed: Aug. 27, 2013

(86) PCT No.: PCT/CN2013/001017
§ 371 (c)(1),
(2) Date: Sep. 2, 2014

(87) PCT Pub. No.: WO2015/006888
PCT Pub. Date: Jan. 22, 2015

(65) Prior Publication Data

US 2016/0249125 A1 Aug. 25, 2016

(30) Foreign Application Priority Data

Jul. 19, 2013 (CN) ..... 2013 1 0304831

(51) Int. Cl.
*H04R 1/10* (2006.01)

(52) U.S. Cl.
CPC ..... *H04R 1/1041* (2013.01); *H04R 1/1066* (2013.01); *H04R 1/1091* (2013.01)

(58) Field of Classification Search
CPC . H04R 1/1041; H04R 1/1066; H04R 1/1091
USPC ..... 381/74, 77
See application file for complete search history.

(56) References Cited

U.S. PATENT DOCUMENTS 6,928,175 B1 * 8/2005 Bader ..... G06F 3/165 381/123

* cited by examiner

*Primary Examiner* — Paul S Kim

(57) ABSTRACT

A jack for preventing a headphone from inputting double audio sources includes: an audio jack set including a left audio jack and a right audio jack, which are respectively provided on bottoms of a left earpiece and a right earpiece of a headphone and for connecting an audio connector. The left audio jack includes a first common grounding contact, a first conductive terminal and a second conductive terminal. The right audio jack includes a second common grounding contact, a third conductive terminal and a fourth conductive terminal. Two audio jacks are provided for users to select. Simple mechanical switches are additionally provided, which only allow one inputted audio signal to input to a left earpiece and a right earpiece of the headphone for playing audio, and thus are capable of preventing users from inputting two different audio sources to the headphone simultaneously.

6 Claims, 5 Drawing Sheets

JACK FOR PREVENTING HEADPHONE FROM INPUTTING DOUBLE AUDIO SOURCES

CROSS REFERENCE OF RELATED APPLICATION

This is a U.S. National Stage under 35 U.S.C 371 of the International Application PCT/CN2013/001017, filed Aug. 27, 2013, which claims priority under 35 U.S.C. 119(a-d) to CN 201310304831.3, filed Jul. 19, 2013.

BACKGROUND OF THE PRESENT INVENTION

1. Field of Invention

The present invention relates to the field of a headphone, and more particularly to a jack for preventing the headphone from inputting double audio sources.

2. Description of Related Arts

FIG. 1 is a sketch view of a conventional headphone jack which has a pair of audio jacks provided thereon. The pair of audio jacks comprises a left audio jack 1 and a right audio jack 2, which are respectively provided on a left earpiece 6 and a right earpiece 7. Both the left audio jack 1 and the right audio jack 2 comprise: a common grounding contact 3 for contacting a core terminal of an audio connector; a left earpiece conductive terminal 4 for contacting an external ring terminal of the audio connector and connecting the left earpiece; and a right earpiece conductive terminal 5 for contacting a middle ring terminal of the audio connector and connecting the right earpiece. When one audio connector is plugged into the left audio jack 1 or the right audio jack 2, inputted audio signals pass through the left earpiece conductive terminal 4 and the right earpiece conductive terminal 5 and then are transmitted to the left earpiece and the right earpiece, in such a manner that the headphone is capable of being utilized normally for playing audio; when two audio connectors are simultaneously plugged into the left audio jack 1 and the right audio jack 2, two inputted audio signals simultaneously pass through the left earpiece conductive terminal 4 and the right earpiece conductive terminal 5, and then are simultaneously transmitted to the left earpiece and the right earpiece, in such a manner that the headphone is capable of being utilized normally to play audio.

The conventional stereo headphone has more than two built-in audio jacks which are respectively provided on the left earpiece and the right earpiece. By plugging the audio connector into the audio jack, users are capable of accomplishing transmitting audio signals inputted by audio sources, such as a music player or a mobile phone, to the stereo headphone to play audio. There are two characteristics in providing two audio jacks. Firstly, users are capable of making a choice to input and selecting any desired one of the two audio jacks. Secondly, users are capable of connecting the audio jack with the audio jack of other stereo headphone, in such a manner that sharing music is achieved. Although the characteristics mentioned above are apparent, this type of structure leads to some disadvantages as follows.

1) A parallel configuration of the two audio jacks will affect the overall impedance of the headphone under a sharing mode and reduce the quality of the music while sharing the music.

2) The music player or the audio source requires a high output to maintain an identical sound power, which leads to distortion and affects the service life of the battery.

3) The problem of mutual interferences between the left channel and the right channel of the headphone will affect other headphones via connection.

SUMMARY OF THE PRESENT INVENTION

In order to overcome the disadvantages mentioned above, an object of the present invention is to provide a jack for preventing the headphone from inputting double audio sources, which is controlled by a simple mechanical switch and has no need of electricity. The jack of the present invention provides convenience for users to select different audio sources, and meanwhile is capable of preventing the user from inputting two different audio sources into the headphone.

The object of the present invention is achieved by the following solutions.

A jack for preventing a headphone from inputting double audio sources, comprises an audio jack set comprising a left audio jack and a right audio jack, which are respectively provided on bottoms of a left earpiece and a right earpiece of a headphone and for connecting with an audio connector, wherein the audio connector comprises a core terminal, a middle ring terminal and an external ring terminal;

the left audio jack comprises a first common grounding contact, a first conductive terminal and a second conductive terminal;

the right audio jack comprises a second common grounding contact, a third conductive terminal and a fourth conductive terminal;

wherein both the first common grounding contact and the second common grounding contact are connected with a common grounding terminal of the left earpiece and the right earpiece, the first common grounding contact and the second common grounding contact are for electrically connecting with the core terminal of the audio connector, when the audio connector is plugged into the audio jack set, the core terminal of the audio connector is contacted and conducted with the common grounding contact;

the first conductive terminal is electrically connected and conducted with the third conductive terminal, a first elastic reed having a convex towards an internal side face of the first conductive terminal is provided on an end portion of the first conductive terminal, a third elastic reed having a convex towards an internal side face of the third conductive terminal is provided on an end portion of the third conductive terminal, both the first elastic reed and the third elastic reed are for connecting with the external ring terminal of the audio connector; when the audio connector is plugged into the audio jack set, the external ring terminal of the audio connector is respectively contacted and conducted with the first elastic reed and the third elastic reed, a first conductive contact provided next to an internal side face of the first elastic reed is connected to the internal side face of the first elastic reed, a third conductive contact provided next to an internal side face of the third elastic reed is connected to the internal side face of the third elastic reed, the first conductive contact is electrically connected and conducted with the third conductive contact, and both the first conductive contact and the third conductive contact are connected with a signal input terminal of the left earpiece;

the second conductive terminal is electrically connected and conducted with the fourth conductive terminal, a second elastic reed having a convex towards an internal side face of the second conductive terminal is provided on an end portion of the second conductive terminal, a fourth elastic reed having a convex towards an internal side face of the fourth conductive terminal is provided on an end portion of the fourth conductive terminal, both the second elastic reed and the fourth elastic reed are for connecting the middle ring terminal of the audio connector, when the audio connector is plugged into the audio jack set, the middle ring terminal of the audio connector is respectively contacted and conducted with the second elastic reed and the fourth elastic reed, a second conductive contact provided next to an internal side face of the second elastic reed is connected to the internal side face of the second elastic reed, a fourth conductive contact provided next to an interval side face of the fourth elastic reed is connected to the internal side face of the fourth elastic reed, the second conductive contact is electrically connected and conducted with the fourth conductive contact, and both the second conductive contact and the fourth conductive contact are connected with a signal input terminal of the right earpiece;

the first elastic reed, the first conductive contact, the second elastic reed and the second conductive contact are combined to form a first mechanical switch, the third elastic reed, the third conductive contact, the fourth elastic reed and the fourth conductive contact are combined to form a second mechanical switch.

When the audio connector is plugged into the left audio jack, the first mechanical switch is triggered, in such a manner that the first mechanical switch is in a disconnected state, in such a manner that the first elastic reed bounces towards an external direction to be detached from the first conductive contact; and simultaneously the second elastic reed also bounces towards an external direction to be detached with the second conductive contact. An inputted audio signal is transmitted to the third elastic reed and the fourth elastic reed from the first elastic reed and the second elastic reed, and the inputted audio signal is then transmitted to signal input terminals of the left earpiece and the right earpiece via the third conductive contact and the fourth conductive contact, in such a manner that the headphone is capable of being utilized normally for playing audio.

When the audio connector is plugged into the right audio jack, the second mechanical switch is triggered, in such a manner that the second mechanical switch is in a disconnected state, in such a manner that the third elastic reed bounces towards an external direction to be detached from the third conductive contact; and simultaneously the fourth elastic reed also bounces towards an external direction to be detached with the fourth conductive contact. An inputted audio signal is transmitted to the first elastic reed and the second elastic reed from the third elastic reed and the fourth elastic reed, and the inputted audio signal is then transmitted to signal input terminals of the left earpiece and the right earpiece via the first conductive contact and the second conductive contact, in such a manner that the headphone is capable of being utilized normally for playing audio.

When two audio connectors are plugged into the left audio jack and the right audio jack, the first mechanical switch and the second mechanical switch are triggered simultaneously, in such a manner that both the first mechanical switch and the second mechanical switch are in a disconnected state, in such a manner that the inputted audio signal is not capable of being transmitted to the left earpiece and the right earpiece, so that the headphone is not capable of being utilized normally for playing audio.

Preferably, the first elastic reed having a convex towards an internal side face is provided opposite to the second elastic reed having a convex towards an internal side face. When the audio connector is plugged into the audio jack set, the first elastic reed and the second elastic reed respectively contact the external ring terminal and the middle ring terminal of the audio connector, in such a manner that both the first elastic reed and the second elastic reed rebound backwards.

Preferably, the third elastic reed having a convex towards an internal side face is provided opposite to the fourth elastic reed having a convex towards an internal side face. When the audio connector is plugged into the audio jack set, the third elastic reed and the fourth elastic reed respectively contact the external ring terminal and the middle ring terminal of the audio connector, in such a manner that both the third elastic reed and the fourth elastic reed rebound backwards.

Preferably, the first conductive contact, the second conductive contact, the third conductive contact and the fourth conductive contact are all made of metallic copper sheets.

Beneficial effects of the present invention are as follows.

Compared with the conventional art, two audio jacks are provided, in such a manner that users are convenient to select different audio jacks. The two audio jacks do not have problems of mutual interference. In addition, simple mechanical switches without electricity are additionally provided. By a mechanical memory established by the mechanical switch, the audio connector is capable of plugging into the left audio jack or the right audio jack. The mechanical switches only allow one inputted audio signal to input to a left earpiece and a right earpiece of the headphone for playing audio, and thus are capable of preventing users from inputting two different audio frequency sources to the headphone simultaneously. Since in the present invention, only one audio connector is allowed for plugging, which avoids that two headphones share the same music, in such a manner that impedance is prevented to affect overall configuration of the headphone, influences on power output of audio player are prevented, and that accumulated interference is avoided.

These and other objectives, features, and advantages of the present invention will become apparent from the following detailed description, the accompanying drawings, and the appended claims.

Figure 1:
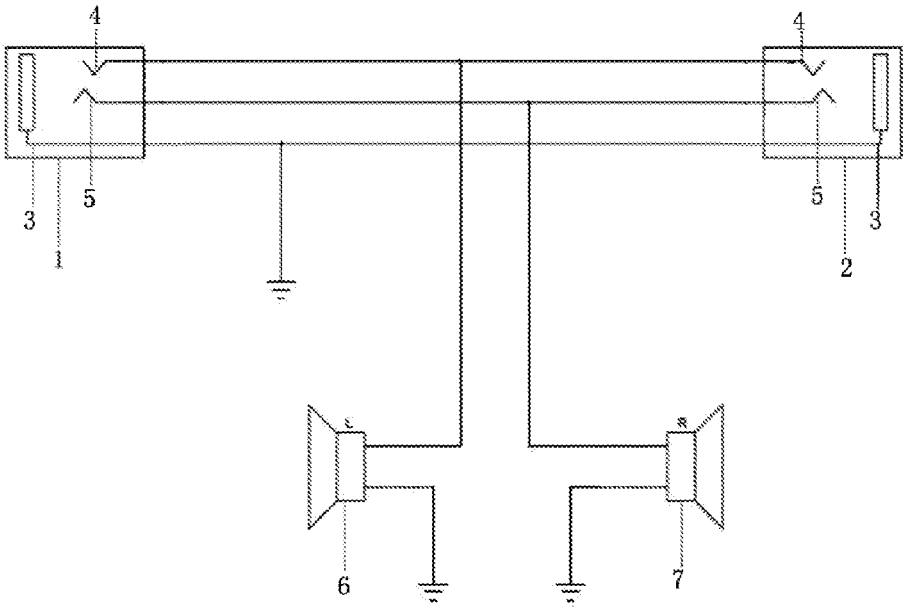
Fig. 1 (Prior Art)
FIG. 1 is a sketch view of a conventional audio jack in the prior art.

In the FIGS. 1—left audio jack; 2—right audio jack; 3—common grounding contact; 4—left earpiece conductive terminal; 5—right earpiece conductive terminal; 6—left earpiece; 7—right earpiece; 8—first common grounding contact; 9—second common grounding contact; 10—first conductive terminal; 11—second conductive terminal; 12—third conductive terminal; 13—fourth conductive terminal; 14—first elastic reed; 15—third elastic reed; 16—first conductive contact; 17—third conductive contact; 18—second elastic reed; 19—fourth elastic reed; 20—second conductive contact; 21—fourth conductive contact; 22—audio connector.

DETAILED DESCRIPTION OF THE PREFERRED EMBODIMENT

Further description of the present invention is illustrated in the preferred embodiment and the accompanying drawings. One skilled in the art will understand that the embodiment of the present invention as shown in the drawings and described above is exemplary only and not intended to be limiting.

Figure 2:
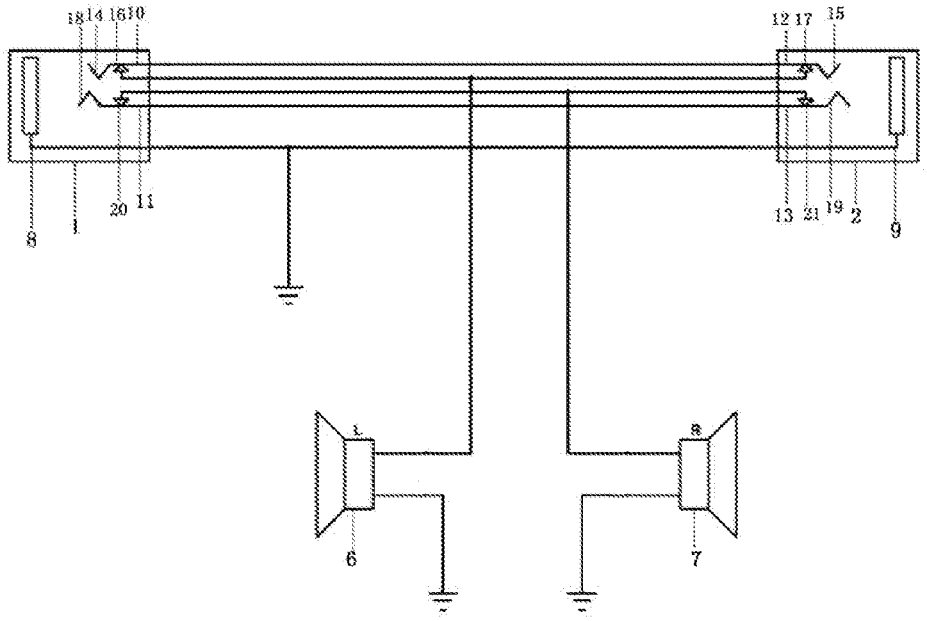
FIG. 2 is a sketch view of an audio jack according to a preferred embodiment of the present invention.

Referring to FIG. 2 of the drawings, according to a preferred embodiment of the present invention, a jack for preventing a headphone from inputting double audio sources, comprises:

an audio jack set comprising a left audio jack 1 and a right audio jack 2, which are respectively provided on bottoms of a left earpiece 6 and a right earpiece 7 of the headphone and for connecting with an audio connector 22, wherein the audio connector 22 comprises a core terminal, a middle ring terminal and an external ring terminal;

the left audio jack 1 comprises a first common grounding contact 8, a first conductive terminal 10 and a second conductive terminal 11;

the right audio jack 2 comprises a second common grounding contact 9, a third conductive terminal 12 and a fourth conductive terminal 13;

wherein both the first common grounding contact 8 and the second common grounding contact 9 are connected with a common grounding terminal of the left earpiece 6 and the right earpiece 7, the first common grounding contact 8 and the second common grounding contact 9 are for electrically connecting with the core terminal of the audio connector 22, when the audio connector 22 is plugged into the audio jack set, the core terminal of the audio connector 22 is contacted and conducted with the common grounding contact;

the first conductive terminal 10 is electrically connected and conducted with the third conductive terminal 12, a first elastic reed 14 having a convex towards an internal side face of the first conductive terminal 10 is provided on an end portion of the first conductive terminal 10, a third elastic reed 15 having a convex towards an internal side face of the third conductive terminal 12 is provided on an end portion of the third conductive terminal 12, both the first elastic reed 14 and the third elastic reed 15 are for connecting with the external ring terminal of the audio connector 22; when the audio connector 22 is plugged into the audio jack set, the external ring terminal of the audio connector is respectively contacted and conducted with the first elastic reed 14 and the third elastic reed 15, a first conductive contact 16 provided next to an internal side face of the first elastic reed 14 is connected to the internal side face of the first elastic reed 14, a third conductive contact 17 provided next to an internal side face of the third elastic reed 15 is connected to the internal side face of the third elastic reed 15, the first conductive contact 16 is electrically connected and conducted with the third conductive contact 17, and both the first conductive contact 16 and the third conductive contact 17 are connected with a signal input terminal of the left earpiece;

the second conductive terminal 11 is electrically connected and conducted with the fourth conductive terminal 13, a second elastic reed 18 having a convex towards an internal side face of the second conductive terminal 11 is provided on an end portion of the second conductive terminal 11, a fourth elastic reed 19 having a convex towards an internal side face of the fourth conductive terminal 19 is provided on an end portion of the fourth conductive terminal 19, both the second elastic reed 18 and the fourth elastic reed 19 are for connecting the middle ring terminal of the audio connector 22, when the audio connector 22 is plugged into the audio jack set, the middle ring terminal of the audio connector is respectively contacted and conducted with the second elastic reed 18 and the fourth elastic reed 19, a second conductive contact 20 provided next to an internal side face of the second elastic reed 18 is connected to the internal side face of the second elastic reed 18, a fourth conductive contact 21 provided next to an internal side face of the fourth elastic reed 19 is connected to the internal side face of the fourth elastic reed 19, the second conductive contact 20 is electrically connected and conducted with the fourth conductive contact 21, and both the second conductive contact 20 and the fourth conductive contact 21 are connected with a signal input terminal of the right earpiece 7;

the first elastic reed 14, the first conductive contact 16, the second elastic reed 18 and the second conductive contact 20 are combined to form a first mechanical switch, the third elastic reed 15, the third conductive contact 17, the fourth elastic reed 19 and the fourth conductive contact 21 are combined to form a second mechanical switch.

Figure 3:
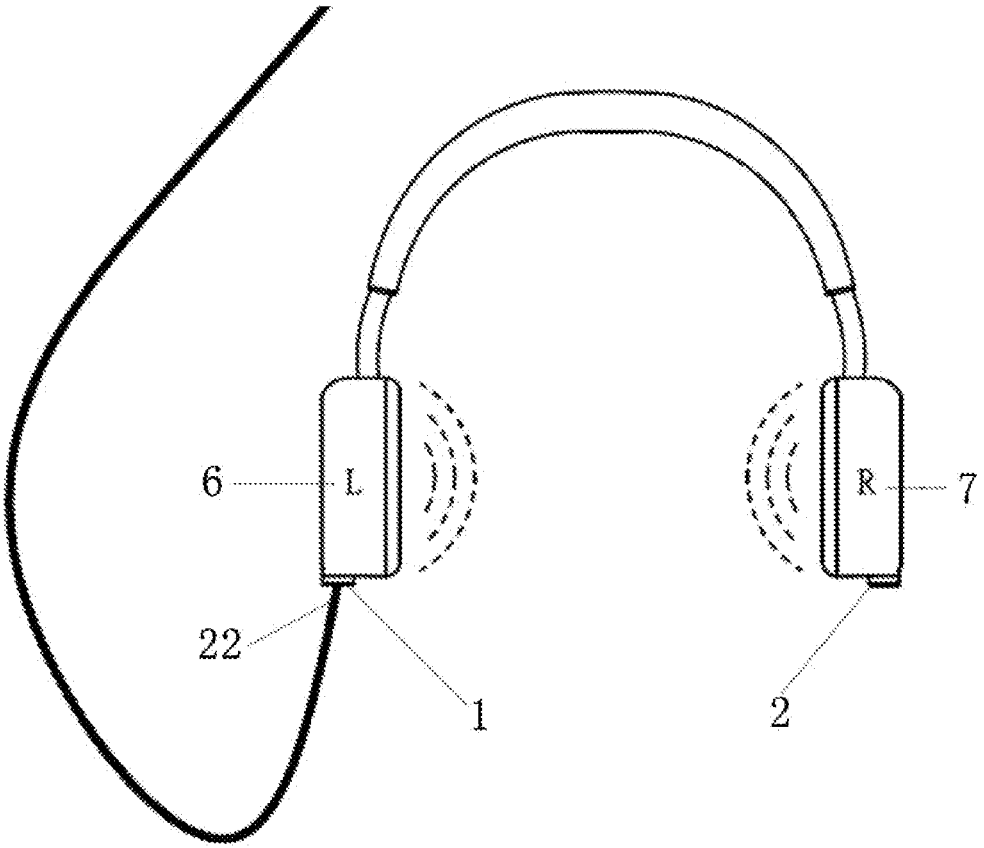
FIG. 3 is a schematic view of a working condition after an audio connector is plugged into a headphone via a left audio jack according to the preferred embodiment of the present invention.

Referring to FIG. 3 of the drawings, when the audio connector 22 is plugged into the left audio jack 1, the first mechanical switch is triggered, in such a manner that the first mechanical switch is in a disconnected state, in such a manner that the first elastic reed 14 bounces towards an external direction to be detached from the first conductive contact 16; and simultaneously the second elastic reed 18 also bounces towards an external direction to be detached with the second conductive contact 20. An inputted audio signal is transmitted to the third elastic reed 15 and the fourth elastic reed 19 from the first elastic reed 14 and the second elastic reed 18, and then the inputted audio signal is then transmitted to signal input terminals of the left earpiece 6 and the right earpiece 7 via the third conductive contact 17 and the fourth conductive contact 21, in such a manner that the headphone is capable of being utilized normally for playing audio.

Figure 4:
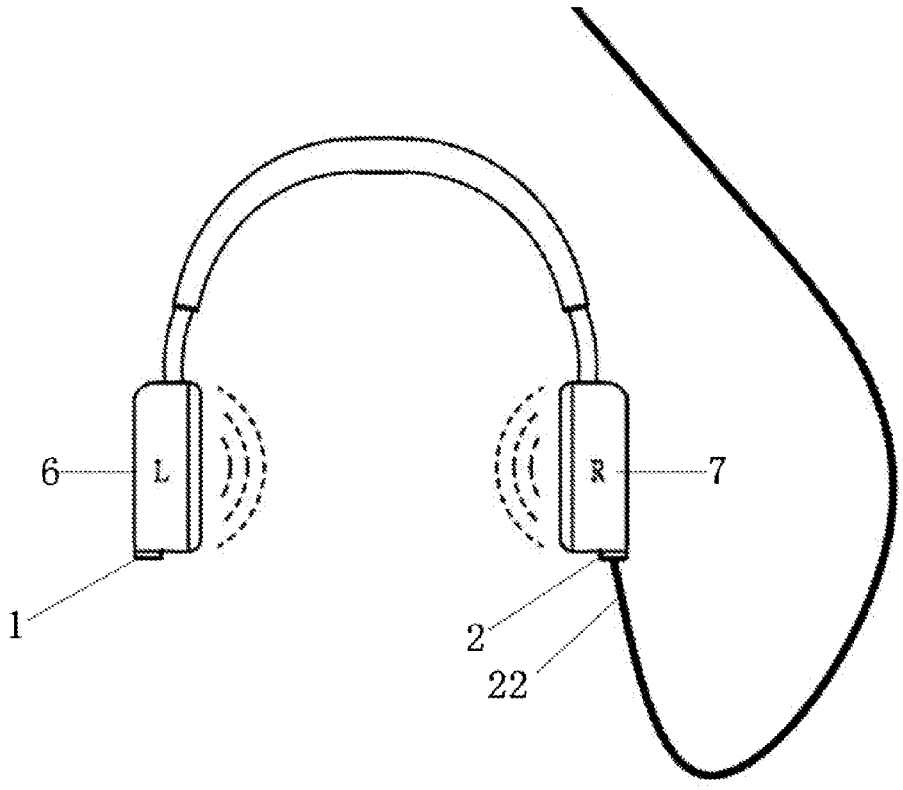
FIG. 4 is a schematic view of a working condition after the audio connector is plugged into the headphone via a right audio jack according to the preferred embodiment of the present invention.

Referring to FIG. 4 of the drawings, when the audio connector 22 is plugged into the right audio jack 2, the second mechanical switch is triggered, in such a manner that the second mechanical switch is in a disconnected state, in such a manner that the third elastic reed 15 bounces towards an external direction to be detached from the third conductive contact 17; and simultaneously the fourth elastic reed 19 also bounces towards an external direction to be detached with the fourth conductive contact 21. An inputted audio signal is transmitted to the first elastic reed 14 and the second elastic reed 18 from the third elastic reed 15 and the fourth elastic reed 19, and the inputted audio signal is then transmitted to signal input terminals of the left earpiece 6 and the right earpiece 7 via the first conductive contact 16 and the second conductive contact 20, in such a manner that the headphone is capable of being utilized normally for playing audio.

Figure 5:
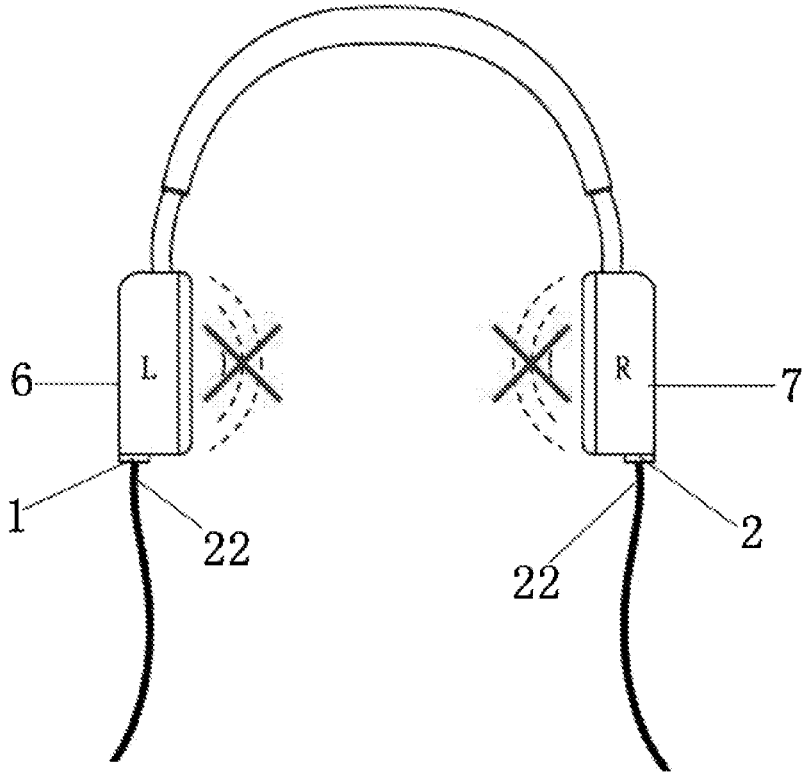
FIG. 5 is a schematic view of a working condition after the audio connector is plugged into the headphone via the left audio jack and the right audio jack simultaneously according to the preferred embodiment of the present invention.

Referring to FIG. 5 of the drawings, when two audio connectors 22 are plugged into the left audio jack 1 and the right audio jack 2, the first mechanical switch and the second mechanical switch are triggered simultaneously, in such a manner that both the first mechanical switch and the second mechanical switch are in a disconnected state, in such a manner that the inputted audio signal is not capable of being transmitted to the left earpiece 6 and the right earpiece 7, so that the headphone is not capable of being utilized normally for playing audio.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A jack for preventing a headphone from inputting double audio sources, comprising:

an audio jack set comprising a left audio jack and a right audio jack, which are respectively provided on bottoms of a left earpiece and a right earpiece of a headphone and for connecting with an audio connector, the left audio jack comprises a first common grounding contact, a first conductive terminal and a second conductive terminal;

the right audio jack comprises a second common grounding contact, a third conductive terminal and a fourth conductive terminal;

wherein both the first common grounding contact and the second common grounding contact are connected with a common grounding terminal of the left earpiece and the right earpiece, the first common grounding contact and the second common grounding contact are for electrically connecting with a core terminal of the audio connector;

the first conductive terminal is electrically connected and conducted with the third conductive terminal, a first elastic reed having a convex towards an internal side face of the first conductive terminal is provided on an end portion of the first conductive terminal, a third elastic reed having a convex towards an internal side face of the third conductive terminal is provided on an end portion of the third conductive terminal, both the first elastic reed and the third elastic reed are for connecting with the external ring terminal of the audio connector;

a first conductive contact provided next to an internal side face of the first elastic reed is connected to the internal side face of the first elastic reed, a third conductive contact provided next to an internal side face of the third elastic reed is connected to the internal side face of the third elastic reed, the first conductive contact is electrically connected and conducted with the third conductive contact, and both the first conductive contact and the third conductive contact are connected with a signal input terminal of the left earpiece;

the second conductive terminal is electrically connected and conducted with the fourth conductive terminal, a second elastic reed having a convex towards an internal side face of the second conductive terminal is provided on an end portion of the second conductive terminal, a fourth elastic reed having a convex towards an internal side face of the fourth conductive terminal is provided on an end portion of the fourth conductive terminal, both the second elastic reed and the fourth elastic reed are for connecting the middle ring terminal of the audio connector, a second conductive contact provided next to an internal side face of the second elastic reed is connected to the internal side face of the second elastic reed, a fourth conductive contact provided next to an internal side face of the fourth elastic reed is connected to the internal side face of the fourth elastic reed, the second conductive contact is electrically connected and conducted with the fourth conductive contact, and both the second conductive contact and the fourth conductive contact are connected with a signal input terminal of the right earpiece;

the first elastic reed, the first conductive contact, the second elastic reed and the second conductive contact are combined to form a first mechanical switch, the third elastic reed, the third conductive contact, the fourth elastic reed and the fourth conductive contact are combined to form a second mechanical switch, when the audio connector is plugged into the left audio jack, the first mechanical switch is triggered, in such a manner that the first mechanical switch is in a disconnected state, in such a manner that the first elastic reed bounces towards an external direction to be detached from the first conductive contact; and simultaneously the second elastic reed also bounces towards an external direction to be detached with the second conductive contact, an inputted audio signal is transmitted to the third elastic reed and the fourth elastic reed from the first elastic reed and the second elastic reed, and the inputted audio signal is then transmitted to signal input terminals of the left earpiece and the right earpiece via the third conductive contact and the fourth conductive contact, when the audio connector is plugged into the right audio jack, the second mechanical switch is triggered, in such a manner that the second mechanical switch is in a disconnected state, in such a manner that the third elastic reed bounces towards an external direction to be detached from the third conductive contact; and simultaneously the fourth elastic reed also bounces towards an external direction to be detached with the fourth conductive contact, an inputted audio signal is transmitted to the first elastic reed and the second elastic reed from the third elastic reed and the fourth elastic reed, and the inputted audio signal is then transmitted to signal input terminals of the left earpiece and the right earpiece via the first conductive contact and the second conductive contact, when two audio connectors are plugged into the left audio jack and the right audio jack, the first mechanical switch and the second mechanical switch are triggered simultaneously, in such a manner that both the first mechanical switch and the second mechanical switch are in a disconnected state, in such a manner that the inputted audio signal is not capable of being transmitted to the left earpiece and the right earpiece.

2. The jack as recited in claim 1, wherein the first elastic reed having a convex towards an internal side face is provided opposite to the second elastic reed having a convex towards an internal side face.

3. The jack as recited in claim 2, wherein the third elastic reed having a convex towards an internal side face is provided opposite to the fourth elastic reed having a convex towards an internal side face.

4. The jack as recited in claim 1, wherein the first conductive contact, the second conductive contact, the third conductive contact and the fourth conductive contact are all made of metallic copper sheets.

5. The jack as recited in claim 2, wherein the first conductive contact, the second conductive contact, the third conductive contact and the fourth conductive contact are all made of metallic copper sheets.

6. The jack as recited in claim 3, wherein the first conductive contact, the second conductive contact, the third conductive contact and the fourth conductive contact are all made of metallic copper sheets.

* * * * *